US005531237A

United States Patent [19]

Yang

[11] Patent Number: 5,531,237

[45] Date of Patent: Jul. 2, 1996

[54] SHELTER MEANS ON UMBRELLA FERRULES FOR CONCEALING WIRE ENDS OF RIB-FASTENING WIRE

[76] Inventor: Chi-Kuo Yang, P.O. Box 55-1670, Taipei, Taiwan

[21] Appl. No.: 550,757

[22] Filed: Oct. 31, 1995

[51] Int. Cl.[6] ..... A45B 25/06

[52] U.S. Cl. ..... 135/28; 135/39

[58] Field of Search ..... 135/28, 37, 38, 135/39, 40, 41

[56] References Cited

U.S. PATENT DOCUMENTS

| | | | |
|---|---|---|---|
| 1,808,610 | 6/1931 | Roy | 135/28 |
| 3,277,909 | 10/1966 | Militano | 135/28 |
| 5,253,666 | 10/1993 | Hiang | 135/28 |

FOREIGN PATENT DOCUMENTS

| | | | |
|---|---|---|---|
| 493867 | 7/1992 | European Pat. Off. | 135/28 |
| 653508 | 5/1963 | Italy | 135/38 |
| 931810 | 7/1963 | United Kingdom | 135/28 |

*Primary Examiner*—Lanna Mai

[57] ABSTRACT

A shelter device is integrally formed with a lower ferrule or an upper ferrule on an umbrella shaft and includes: a base portion formed on a ring portion of the lower ferrule or the upper ferrule having a fastening wire for fastening the ribs on the ferrule, a sheath portion longitudinally protruding from the base portion to be contiguous to a cylindrical wall of the ferrule, and a tubular hole longitudinally formed through the sheath portion, whereby upon concealing of a twisted knot of the two wire ends of the fastening wire into the tubular hole in the sheath portion of the shelter device, the acute wire ends of the fastening wire will not prick the umbrella user or assembly worker for safety purpose.

4 Claims, 2 Drawing Sheets

SHELTER MEANS ON UMBRELLA FERRULES FOR CONCEALING WIRE ENDS OF RIB-FASTENING WIRE

BACKGROUND OF THE INVENTION

A conventional lower ferrule or runner 12 slidably held on a central shaft 1 of an umbrella as shown in FIG. 4 includes a fastening steel wire 3 fastened on the ferrule 12 for pivotally securing a plurality of ribs 2 of the umbrella. Two free wire ends 30 of the wire 3 will be twisted for tying a knot of the two free wire ends 30 to be kept on the ferrule 12. The wire end 30 after being cut will form an acute tip to easily prick an umbrella user or a factory assembly worker to cause pricking injury to the user or worker. Meanwhile, the acute wire ends 30 remarkably existing on the umbrella ferrule may influence a decorative appearance and product quality of the umbrella.

SUMMARY OF THE INVENTION

The object of the present invention is to provide a shelter device integrally formed with a lower ferrule or an upper ferrule on an umbrella shaft, including: a base portion formed on a ring portion of the lower ferrule or the upper ferrule having a fastening wire for fastening the ribs on the ferrule, a sheath portion longitudinally protruding from the base portion to be contiguous to a cylindrical wall of the ferrule, and a tubular hole longitudinally formed through the sheath portion, whereby upon concealing of a twisted knot of the two wire ends of the fastening wire into the tubular hole in the sheath portion of the shelter device, the acute wire ends of the fastening wire will not prick the umbrella user or assembly worker for safety purpose.

DETAILED DESCRIPTION

Figure 1:
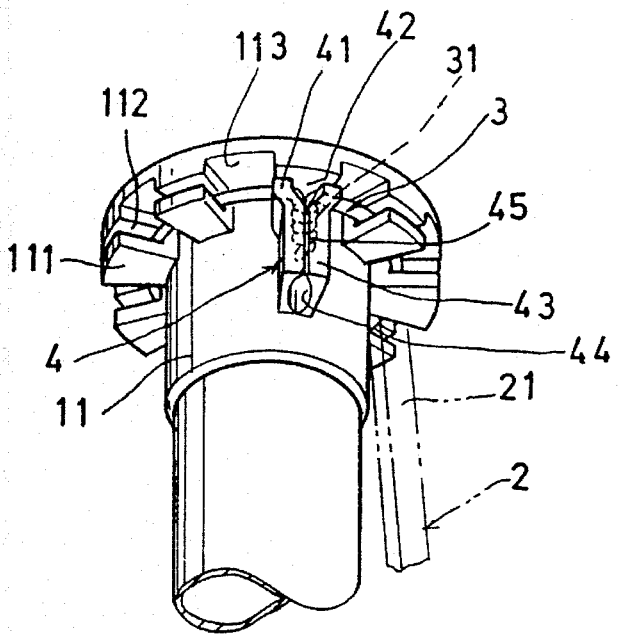
FIG. 1 is an illustration showing a shelter means of the present invention when formed on an upper ferrule of the umbrella.
Figure 4:
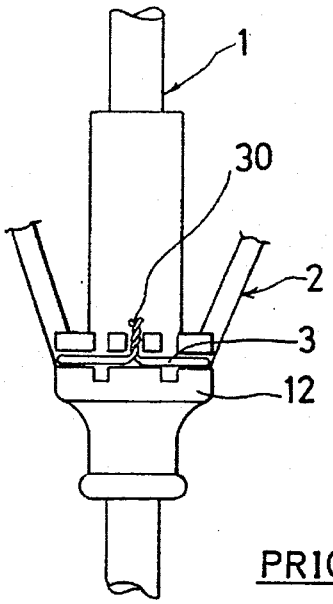
PRIOR ART FIG.4
FIG. 4 shows a conventional lower ferrule or runner having acute wire ends of a fastening wire revealed on the ferrule.
Figure 2:
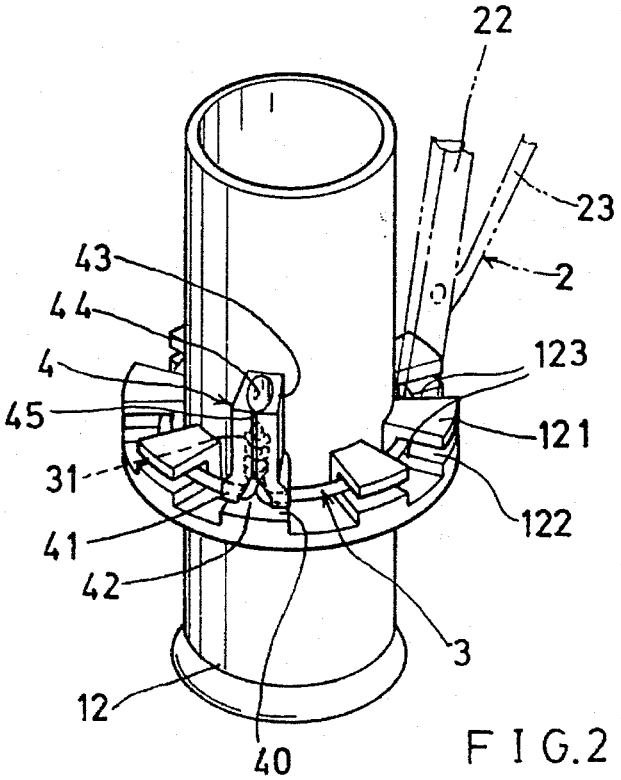
FIG. 2 shows a shelter means of the present invention when formed on a lower ferrule of the umbrella.
Figure 3:
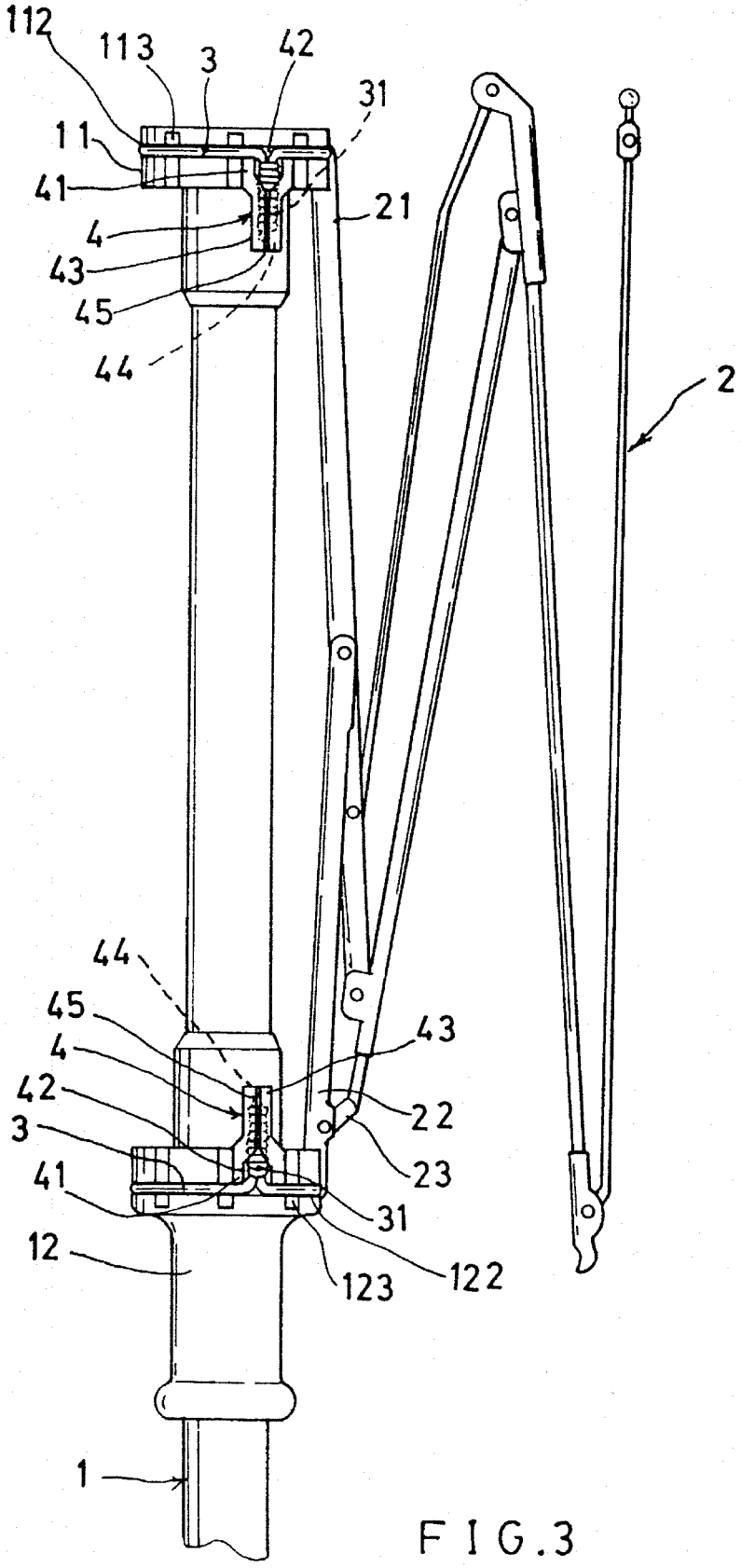
FIG. 3 is an illustration of an umbrella having an upper ferrule and a lower ferrule respectively formed with shelter means of the present invention on the two ferrules.

As shown in FIGS. 1–3, the shelter means 4 of the present invention is formed on the upper ferrule (or notch) 11 and also formed on the lower ferrule (or runner) 12 held on a central shaft 1 of the umbrella.

The upper ferrule 11 as shown in FIG. 1 includes: an upper ring portion 111 circumferentially formed on the upper ferrule 11, an upper wire groove 112 annularly recessed in the upper ring portion 111 for engaging the fastening wire 3 in the groove 112, and a plurality of upper rib slots 113 radially formed in the upper ring portion 111 each upper rib slot 113 provided for pivotally securing each top rib 21 of the rib means 2 of the umbrella about the fastening wire 3 fastened in the upper wire groove 112; with one shelter means 4 formed on the upper ring portion 111 for concealing a twisted knot 31 by tying two free wire ends of the fastening wire 3 as shown in dotted line in the shelter means 4 of FIG. 1.

The lower ferrule (or runner) 12 as shown in FIG. 2 is similar to the structure as that of the upper ferrule (or notch) 11 as shown in FIG. 1. The lower ferrule 12 is pivotally secured with a plurality of stretcher ribs 22 of the rib means 2 for securing an umbrella cloth (not shown) thereon. A connecting rib 23 is pivotally connected with the stretcher rib 22 to the other ribs (not designated with numerals) of the rib means 2 which is so conventional and is not described in detail herein.

The lower ferrule 12 includes: a lower ring portion 121 circumferentially formed on the lower ferrule 12, a lower wire groove 122 annularly recessed in the lower ring portion 121 for engaging the fastening wire 3 in the groove 122, and a plurality of lower rib slots 123 radially formed in the lower ring portion 121 each lower rib slot 123 provided for pivotally securing each stretcher rib 22 of the rib means 2 of the umbrella about the fastening wire 3 fastened in the lower wire groove 122; with another shelter means 4 formed on the lower ring portion 121 for concealing a twisted knot 31 by tying two free wire ends of the fastening wire 3 as shown in dotted line in the shelter means 4 of FIG. 2.

The shelter means 4 may be integrally formed with either upper ferrule 11 or lower ferrule 12 during the plastic molding process; or the shelter means 4 may be further adhered or joined onto the ferrule 11 or 12 by any bonding or joining methods, not limited in this invention.

The shelter means 4 includes: a base portion 41 formed on each said ferrule 11 or 12 having a wire recess 40 recessed inwardly in said base portion 41 for securing the fastening wire 3 therein, a guiding port 42 formed in a central front portion of the base portion 41 and communicating with the wire recess 40 of said base portion 41, a sheath portion 43 longitudinally protruding from the base portion 41 to be contiguous to an outer surface of each said ferrule 11 or 12, a tubular hole 44 longitudinally formed in a central hollow portion in said sheath portion 43 for storing said twisted knot 31 of two wire ends of the fastening wire 3 in said tubular hole 44, and a slit 45 longitudinally formed in a front wall of said sheath portion 43 to communicate with the tubular hole 44 in said sheath portion 43, whereby upon an insertion of the twisted knot 31 of the two wire ends of the fastening wire 3 into the sheath portion 43 through said guiding port 42 and said slit 45, said twisted knot 31 of the two wire ends will be safely stored in said tubular hole 44 without pricking an umbrella user or assembly worker.

The guiding port 42 may be formed as a triangular shape tapered from the wire recess 40 towards the slit 45 for smoothly pressing the twisted knot 31 of the fastening wire 3 inwardly into the tubular hole 44 through the guiding port 42 for ergonomically inserting the twisted knot 31 of the fastening wire 3 into the sheath portion 43 of the shelter means 4.

The slit 45 has a width small than a diameter of the tubular hole 44 in the sheath portion 43 for irreversibly inserting the twisted knot 41 of the fastening wire 3 into the tubular hole 44, that is, to allow a single-way insertion of the twisted knot of the wire ends 31 into the hole 44 but preventing an outward re-protruding of the wire ends as released from the hole 44 for an absolute safety purpose.

The tubular hole 44 may be longitudinally formed through the sheath portion 43 of the shelter means 4, having an outermost end portion of the tubular hole 44 sealed by any conventional methods, such as by thermally melting the plastic material for sealing the upper portion of the hole 44, to completely preclude any outward protrusion of the twisted knot 31 of two wire ends of the fastening wire 3.

The present invention has improved the shortcoming of unshielded wire ends of the fastening wire of a conventional umbrella by concealing the wire ends 31 into the shelter means 4 without outwardly pricking the user or worker for enhancing safety in our life. Meanwhile, a smooth appearance of an umbrella without acute portions can be obtained for increasing the umbrella quality and decorative meaning as well as commercial values of the umbrella.

The present invention may be modified without departing from the spirit and scope of this invention.

I claim:

1. In an umbrella including an upper ferrule and a lower ferrule held on a central shaft of the umbrella for pivotally securing at least two ribs of a rib means between the upper and the lower ferrules for securing an umbrella cloth on the rib means, each said ferrule having a shelter means formed thereon and having a fastening wire fastened in a wire groove recessed in a ring portion of said ferrule for pivotally securing each said rib of said rib means on said fastening wire having two opposite free wire ends of said wire tied to form a twisted knot to be concealed in said shelter means formed on each said ferrule, said shelter means including: a base portion formed on each said ferrule having a wire recess recessed inwardly in said base portion for securing the fastening wire therein, a guiding port formed in a central front portion of the base portion and communicating with the wire recess of said base portion, a sheath portion longitudinally protruding from the base portion to be contiguous to an outer surface of said ferrule, a tubular hole longitudinally formed in a central hollow portion in said sheath portion for storing said twisted knot of the two wire ends of the fastening wire in said tubular hole, and a slit longitudinally formed in a front wall of said sheath portion to communicate with the tubular hole in said sheath portion, whereby upon an inward insertion of the twisted knot of the two wire ends of the fastening wire in said sheath portion through said guiding port and said slit, said twisted knot of the two wire ends of the fastening wire will be safely stored in said tubular hole without pricking a person.

2. A shelter means according to claim 1, wherein said guiding port is formed as a triangular shape and tapered from the wire recess in said base portion towards the slit of said sheath portion for smoothly pressing the twisted knot of the fastening wire inwardly into the tubular hole through the guiding port.

3. A shelter means according to claim 1, wherein said slit has a width small than a diameter of the tubular hole in the sheath portion for irreversibly inserting the twisted knot of the fastening wire into the tubular hole for preventing an outward re-protruding of the wire ends as released from the tubular hole for safety.

4. A shelter means according to claim 1, wherein said tubular hole is longitudinally formed through the sheath portion of the shelter means, having an outermost end portion of the tubular hole sealed for preventing an outward protrusion of said twisted knot of said fastening wire beyond said tubular hole.

* * * * *